US005125204A

United States Patent [19]

Porter

[11] Patent Number: 5,125,204

[45] Date of Patent: Jun. 30, 1992

[54] SNAP-IN PANEL MOUNTING ARRANGEMENT

[76] Inventor: William H. Porter, P.O. Box 249, Saugatuck, Mich. 49453

[21] Appl. No.: 522,649

[22] Filed: May 14, 1990

[51] Int. Cl.[5] ..... F04C 1/00

[52] U.S. Cl. ..... 52/393; 52/588; 52/762

[58] Field of Search ..... 52/393, 588, 403, 762, 52/506, 511, 169.7

[56] References Cited

U.S. PATENT DOCUMENTS

| | | | |
|---|---|---|---|
| 800,655 | 10/1905 | Kitsee . | |
| 830,313 | 9/1906 | Fenn . | |
| 874,909 | 12/1907 | Fischer . | |
| 938,768 | 11/1909 | Kenny . | |
| 1,723,307 | 8/1929 | Sipe | 52/395 |
| 1,850,961 | 3/1932 | Mortenson . | |
| 1,861,359 | 5/1932 | Pyron . | |
| 1,946,690 | 2/1934 | Haines . | |
| 1,994,644 | 3/1935 | Harschberger . | |
| 2,005,380 | 6/1935 | Marsh et al. . | |
| 2,043,706 | 6/1936 | Myers . | |
| 2,054,573 | 9/1936 | Mendenhall . | |
| 2,102,247 | 12/1937 | Whelan | 52/262 |
| 2,202,568 | 5/1940 | Worden . | |
| 2,339,865 | 1/1944 | Larmour . | |
| 2,682,938 | 7/1954 | MacDonald . | |
| 2,730,772 | 1/1956 | Jones . | |
| 2,803,858 | 8/1957 | Rader . | |
| 2,907,287 | 10/1959 | Trostle . | |
| 2,916,261 | 12/1959 | Parkinson et al. . | |
| 2,962,323 | 11/1960 | McBride . | |
| 3,111,787 | 11/1963 | Chamberlain . | |
| 3,228,822 | 1/1966 | Norman . | |
| 3,232,395 | 1/1966 | LaBarge | 52/762 |
| 3,270,473 | 9/1966 | Smith . | |
| 3,313,073 | 4/1967 | Mathews . | |
| 3,367,076 | 2/1968 | O'Brien . | |
| 3,387,422 | 6/1968 | Wanzer . | |
| 3,415,028 | 12/1968 | Nerem . | |
| 3,427,663 | 2/1969 | O'Connell | 52/588 |
| 3,479,784 | 11/1969 | Massagli . | |
| 3,514,915 | 6/1970 | Johnson . | |
| 3,533,206 | 10/1970 | Passeno, Jr. . | |
| 3,535,844 | 10/1970 | Glaros . | |
| 3,667,180 | 6/1972 | Tischuk . | |
| 3,740,911 | 6/1973 | O'Leary . | |
| 3,742,672 | 7/1973 | Schaeufele . | |
| 3,760,548 | 9/1973 | Sauer et al. . | |
| 3,789,556 | 2/1974 | Skinner . | |
| 3,818,659 | 6/1974 | Anderson . | |
| 3,835,606 | 9/1974 | Liberman . | |

(List continued on next page.)

FOREIGN PATENT DOCUMENTS

| | | | |
|---|---|---|---|
| 250639 | 1/1966 | Australia | 52/762 |
| 2292085 | 5/1936 | France . | |

*Primary Examiner*—John E. Murtagh
*Attorney, Agent, or Firm*—Emrich & Dithmar

[57] ABSTRACT

A snap-in-place mounting arrangement for securely attaching generally flat panels to a support structure such as a wall or a roof includes an attachment strip having a pair of compressible, resilient gaskets for securely engaging adjacent edges of a pair of panels. The attachment strip is affixed to the support structure by screws, nails or an adhesive and includes first and second outer tabs and a center tab disposed therebetween. The center tab includes an arrowhead-shaped tip which is adapted to engage and retain the first and second gaskets respectively inserted between the center tab and the first and second outer tabs. Angled edge portions of a pair of panels are each adapted for insertion between and engagement by a respective gasket and the center tab for attaching the panels to the support structure via the attachment strip. One embodiment of the snap-in-place panel mounting arrangement includes a flexible attachment strip affixed to a curvilinear support structure and conforming to the contour thereof which are having a plurality of spaced tabs on an edge thereof which are adapted to engage the attachment strip and allow the panel to conform to the curvilinear contour of the support structure. The snap-in panel mounting arrangement is also adapted for use with insulated panels having facing panel sheets disposed on opposed surfaces of an intermediate insulating layer.

30 Claims, 2 Drawing Sheets

U.S PATENT DOCUMENTS 3,886,676 6/1975 Alfonso .
3,962,504 6/1976 Sherwin .
3,975,880 8/1976 Fischer, Jr. .
4,009,548 3/1977 Hicks .
4,020,611 6/1977 Amos .
4,037,377 7/1977 Howell et al. .
4,068,437 1/1978 Byxbe et al. .
4,100,710 7/1978 Kowallik .
4,104,840 8/1978 Heintz et al. .
4,135,342 1/1979 Cotter .
4,139,974 2/1979 Fox .
4,155,206 5/1979 Player .
4,186,539 2/1980 Harmon et al. .
4,244,151 1/1981 Seem .
4,246,735 1/1981 Herzfeld .
4,304,083 12/1981 Anderson .
4,307,553 12/1981 Puckett .
4,316,351 2/1982 Ting .
4,366,656 1/1983 Simpson .
4,373,312 2/1983 Kim .
4,435,934 3/1984 Kim .
4,443,988 4/1984 Coutu, Sr. .
4,575,981 3/1986 Porter .
4,599,842 7/1986 Counihan .
4,662,140 5/1987 Porter et al. .
4,671,038 6/1987 Porter .
4,700,520 10/1987 Ting .
4,769,963 9/1988 Meyerson .

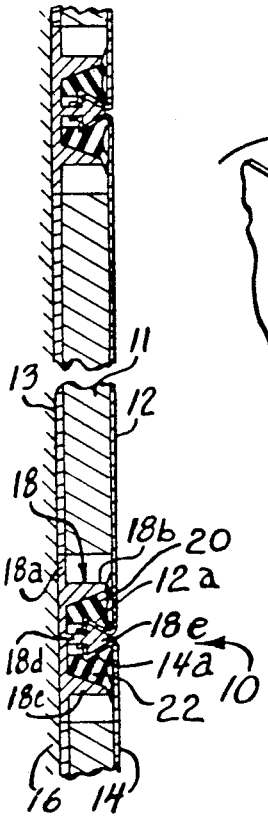
FIG. 1
FIG. 3
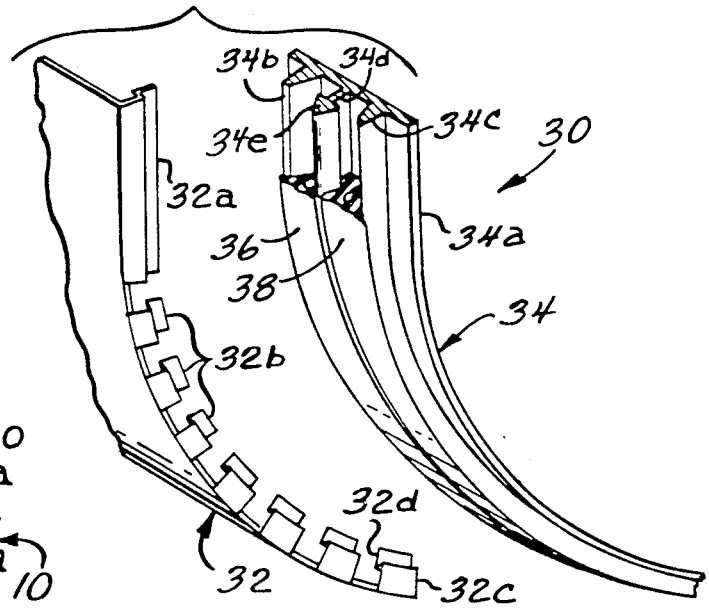
FIG. 2
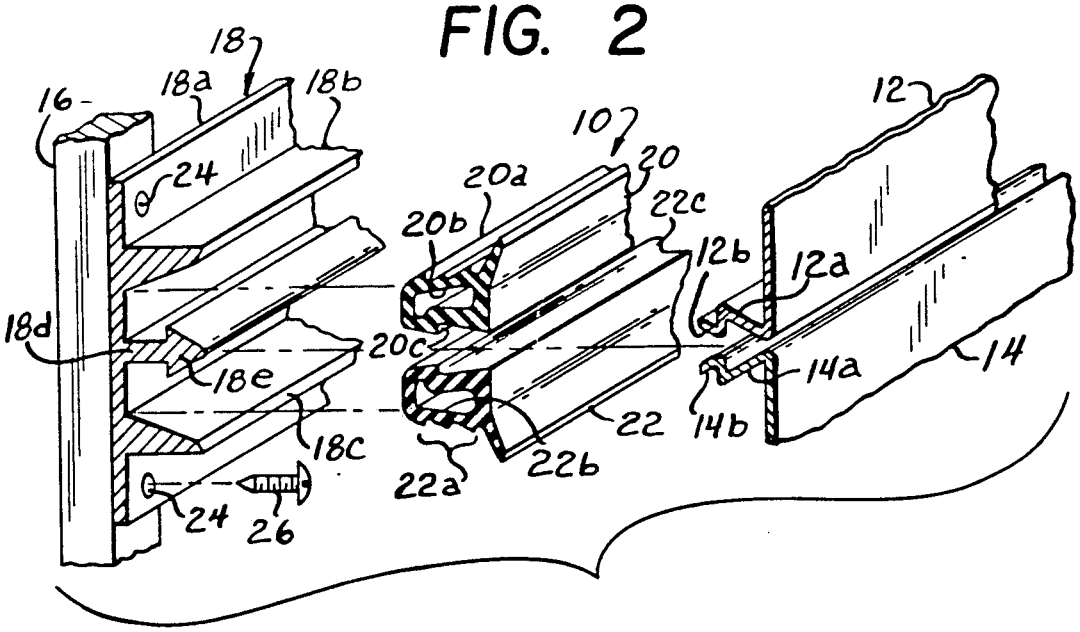

SNAP-IN PANEL MOUNTING ARRANGEMENT

BACKGROUND OF THE INVENTION

This invention relates generally to structural panels used in building construction and is particularly directed to a snap-in-place mounting arrangement for attaching building panels to a support structure.

Flat panels are used in building construction to form a variety of structures. These panels are typically fastened to building frame members, such as horizontal wall girts, vertical mullions, or roof purlins in a side-by-side fashion to form an inner or outer wall or a ceiling or roof surface. Flat panels joined together in an edge abutting manner may also form a floor structure.

The panels are frequently coupled together along respective adjacent edges thereof and are secured to the support structure at the edge portions of the panel. Coupling adjacent edge portions of a pair of panels increases the strength of the panel structure, e.g., wall, ceiling, etc., as well as its attachment to the support structure, eliminates gaps between adjacent panels for improved esthetics and protection of panel edges, and frequently seals the gap between adjacent panels to protect the underlying structure such as in roof and outer wall applications. Interconnections between adjacent panels can be provided by interlocking panel edge arrangements, such as of the tongue and groove type, with hidden connectors and fastening strips. Examples of this type of panel mounting approach can be found in U.S. Pat. Nos. 4,244,151 to Seem; 4,575,981 to Porter; 4,599,842 to Counihan; 4,671,038 to Porter and 4,700,520 to Ting. Adjacent edges of panels are also sometimes crimped together or coupled by means of pop rivets. Examples of this type of panel mounting approach can be found in U.S. Pat. Nos. 4,307,553 to Puckett and 4,366,656 to Simpson. These panel mounting and coupling arrangements generally preclude removal of the panels once installed and are labor intensive requiring a large number of individual inter-panel connections. Threaded fasteners are also sometimes used for connecting adjacent panels and while this approach permits removal of the panels, it too is a labor intensive and thus expensive installation method. Examples of this type of panel mounting approach can be found in U.S. Pat. Nos. 3,667,180 to Tischuk; 4,443,988 to Coutu, Sr. and 4,575,981 to Porter. Prior approaches which facilitate panel mounting in an expeditious and cost effective manner have generally not provided the attractiveness of hidden mounting hardware in a weatherproof, inter-panel connection.

The present invention overcomes the aforementioned limitations of the prior art by providing a snap-in mounting arrangement for flat panels which employs an attachment strip affixed to a support structure and a pair of elongated, linear grooves into which a respective gasket strip is inserted. A center tab having an arrowhead-shaped tip is disposed between the two grooves in the attachment strip for retaining the gaskets in place and engaging adjacent contoured edges of a pair of panels. The panel mounting and coupling hardware is substantially hidden from view and flush with the surface of the adjacent, coupled panels, greatly facilitates panel installation; and permits flexible panels to be mounted to and assume the contour of a curvilinear surface of a support structure.

OBJECTS AND SUMMARY OF THE INVENTION

Accordingly, it is an object of the present invention to provide a snap-in-place mounting arrangement for securely holding building panels in place.

It is another object of the present invention to securely mount adjacent building panels to a support structure in a manner which provides a flat, smooth, outer surface with a weather seal between the edges of adjacent panels.

Yet another object of the present invention is to mount adjacent panels on a support structure in a manner which positions virtually all of the panel mounting and sealing hardware below the outer surfaces of the panels and thus hidden from view.

A further object of the present invention is to provide a building panel mounting arrangement which permits the panel and mounting hardware to bend and flex so as to conform with the contour of a curvilinear support structure.

A still further object of the present invention is to securely attach a panel to a support structure without exposed fasteners.

Another object of the present invention is to provide an arrangement for mounting a panel to a support structure which is easily assembled, inexpensive, water-tight and secure.

It is a further object of the present invention to provide a flexible panel having contoured edge extensions which are notched for securely attaching the panel to a flexible extrusion attached to a contoured support structure which permits the panel to flex and assume the contour of the support structure.

This invention contemplates an arrangement for attaching a generally flat panel to a support structure comprising: an attachment strip mounted to the support structure and including first and second spaced tabs extending along the length of the strip and forming a slot along the strip, the first tab having an enlarged distal end with a first contoured surface; first compressible, resilient sealing means disposed intermediate the first tab and the second tab and within the slot and extending along the length of the strip; and an edge portion on the panel forming an angle with a plane of the panel and having a second contoured surface, wherein the second contoured surface is complementary to the first contoured surface and the edge portion is adapted for tight fitting insertion between the first tab and the sealing means so as to place the first and second contoured surfaces in intimate contact and wherein the sealing means provides a seal between said attachment strip and an inner surface of the flat panel.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 a sectional view of a snap-in mounting arrangement for building panels in accordance with the present invention;

FIG. 2 is an exploded perspective view showing details of the various components of the snap-in mounting arrangement for panels shown in FIG. 1;

FIG. 3 is a perspective view of a snap-in mounting arrangement for attaching a flexible panel to a contoured, or curvilinear, surface of a support structure in accordance with another embodiment of the present invention.

DESCRIPTION OF THE PREFERRED EMBODIMENTS

Figure 4:
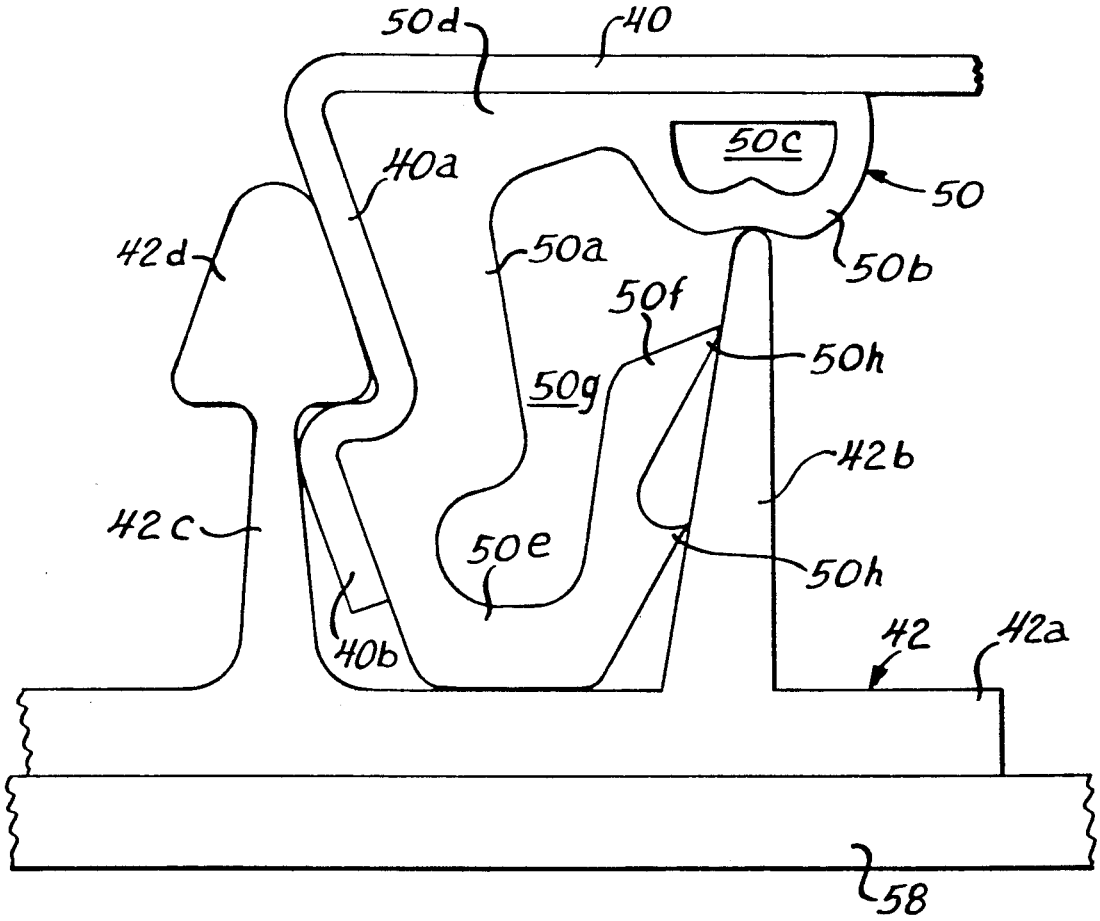
FIG. 4 is a sectional view of a gasket used in one embodiment of the present invention.

Referring to FIG. 1, there is shown a sectional view of a snap-in panel mounting arrangement 10 in accordance with the principles of the present invention. An exploded perspective view of the snap-in panel mounting arrangement 10 of FIG. 1 is shown in FIG. 2.

The snap-in panel mounting arrangement 10 is adapted for securely coupling first and second panels 12 and 14 and for attaching the panels to a support structure 16. The support structure 16 may be a stud as shown in FIG. 2 or virtually any structural member which supports a wall, roof, floor, etc., of a building. The snap-in panel mounting arrangement 10 includes an attachment strip 18 which is typically comprised of plastic or of an elongated, linear extruded member, such as of aluminum, and which in one embodiment may be of formed metal. The attachment strip 18 is adapted for secure mounting to the support structure 16 by means of a plurality of mounting pins 26, which may be conventional screws or nails, each of which is adapted for insertion through a respective aperture 24 in the attachment strip and engagement with the support structure 16. An adhesive may also be used to attach the strip 18 to the support structure 16. In a preferred embodiment, the attachment strip 18 is comprised of an aluminum extrusion.

The attachment strip 18 includes a base portion **18*a*, first and second outer tabs 18*b* and 18*c*, and a center tab 18*d*. The first and second outer tabs 18*b*, 18*c* and the center tab 18*d* extend from the base portion 18*a* generally transversely and are aligned in a parallel manner along the length of the attachment strip 18. The center tab 18*d* is disposed intermediate and equally distant from the first and second outer tabs 18*b*, 18*c* and includes an arrowhead-shaped distal end, or tip, 18*e*. A gap, or slot, disposed between the first outer tab 18*b* and the center tab 18*d* is adapted for receiving a linear, elongated first gasket 20. Similarly, a slot disposed between the second outer tab 18*c* and the center tab 18*d* is adapted for receiving a second gasket 22. The surfaces of the first and second outer tabs 18*b*, 18*c* facing the center tab 18*d* are tapered inwardly to ensure that the first and second gaskets 20, 22 are securely engaged when inserted between the center tab and one of the outer tabs. Distal ends of the first and second outer tabs 18*b*, 18*c* are beveled inwardly to facilitate insertion of a gasket between an outer tab and the center tab 18*d***.

Each of the first and second gaskets 20, 22 is preferably comprised of a high strength, compressible and resilient material which is weather resistant such as rubber or elastomeric plastic. Each of these gaskets may also be provided with a respective channel **20*b*, 22*b* disposed therein and extending the length thereof to enhance the compressibility of the gasket and improve coupling to and engagement with facing surfaces of the inner and outer tabs. Outer surfaces of the first and second gaskets 20, 22 are each provided with a plurality of spaced, parallel ribs 20*a* and 22*a* for ensuring more secure engagement of the gasket with the adjacent surface of the outer tab which it contacts. Each of the first and second gaskets 20, 22 is further provided with a respective inner shoulder 20*c*, 22*c* which engages the arrowhead-shaped distal end 18*e* of the center tab 18*d* when the gasket is inserted in position between the center tab and one of the outer tabs. The combination of the outer ribbed portion, the inner shoulder, and inner channel for enhanced compressibility of each of the gaskets ensures that the gaskets are securely maintained in position in the attachment strip 18 when inserted between the center tab 18*d* and one of the outer tabs 18*b*, 18*c*. When inserted in the attachment strip 18, a distal end of each of the first and second gaskets 20, 22 is aligned generally with the tip portion of the arrowhead-shaped distal end 18*e* of the center tab 18*d*. Although shown with an inner channel, this is not an essential part of either of the first or second gaskets 20, 22, which may equally as well be comprised of a solid, compressible material. Each of the gaskets may also be comprised of a plastic foam which expands upon aging to securely engage an edge of a panel as described below. Once inserted in the attachment strip 18**, removal of these gaskets is very difficult and requires a large force.

The first and second panels 12, 14 each includes a respective proximal leg portion **12*a*, 14*a* forming an approximately 110° angle with the plane of the panel. Each adjacent edge of the first and second panels further includes a distal leg portion 12*b*, 14*b* which is coupled to and continuous with its associated proximal leg portion and also forms an obtuse angle with the plane of the panel. The angled orientation of the distal leg portion 12*b*, 14*b* of the first and second panels 12, 14 facilitates sliding engagement of the panel edge with the arrowhead-shaped distal end 18*e* of the center tab 18*d* and permits the panel edges to be inserted between the center tab and a respective one of the gaskets. Thus, the first panel 12 is coupled to the attachment strip 18 by displacing the panel edge toward the base portion 18*a* of the strip with the distal leg edge portion 12*b* engaging the arrowhead-shaped distal end 18*e* of the center tab 18*d*. Continued displacement of the panel edge toward the base portion 18*a* of the attachment strip 18 causes the edge portion disposed between the proximal and distal leg portions 12*a* and 12*b* to engage an inner edge portion of the center tab's arrowhead-shaped distal end 18*e* as well as the inner shoulder 20*c* of the first gasket 20. The angled orientation of the proximal and distal leg portions 12*a* and 12*b* of the first panel 12 facilitates insertion of the edge of the first panel between the first gasket 20 and the center tab 18*d* of the attachment strip 18. Similar geometry and dimensions of the edge of the second panel 14 facilitates its insertion between the second gasket 22 and the center tab 18*d* of the attachment strip 18. Once inserted in the attachment strip 18**, removal of a panel requires considerable force.

The resilient, compressible characteristic of the first and second gaskets 20, 22 forms a waterproof weather shield between the first and second panels 12, 14 and prevents water from entering the space between the support structure 16 and the panels. As shown in FIG. 1, the snap-in panel mounting arrangement 10 may be used with insulated structural members comprised of a first outer panel 12, a second inner panel 13, and a layer of insulation 11, such as of an insulating foam, disposed therebetween. FIG. 1 also illustrates the snap-in panel mounting arrangement 10 of the present invention may be used to securely attach a pair of opposed edges of a panel 12 to the support structure 16. The present invention further includes providing a snap-in panel mounting arrangement 10 as described herein on four sides of a rectangular shaped panel, or even on all sides of a panel without regard to its specific shape. When installing a panel on the attachment strip 18, a gasket is preferably attached to an edge portion of the panel such as via an adhesive and the panel edge and gasket combination is then inserted in a snap-acting manner between the center tab and an outer tab of the attachment strip.

Referring to FIG. 3, there is shown another embodiment of a snap-in panel mounting arrangement 30 in accordance with the present invention. The snap-in panel mounting arrangement 30 includes a curvilinear attachment strip 34 which is adapted for attachment to a non-planar support structure (not shown for simplicity) by conventional means such as described above. The attachment strip 34 is preferably comprised of a flexible material which permits it to conform to the outer contour of a non-planar, curvilinear support structure. As in the earlier embodiment, the attachment strip 34 includes a base portion 34*a*, first and second outer tabs 34*b* and 34*c*, and a center tab 34*d* disposed therebetween. The center tab 34*d* is provided with an arrowhead-shaped distal end 34*e*. The slot between the first outer tab 34*b* and the center tab 34*d* is adapted to receive a first compressible gasket 36, while the slot between the second outer tab 34*c* and the center tab is adapted to receive a second gasket 38 in tight fitting relation.

The panel 32 is preferably comprised of a flexible material and is adapted for secure engagement with the attachment strip 34 as described above for mounting to a curvilinear support structure. The panel 32 is provided with a contoured edge 32*a* extending over a substantially planar portion of the panel and a plurality of spaced tabs 32*b* extending over a curvilinear portion of the panel 32. Each of the tabs 32*b* includes a respective proximal portion 32*c* and a distal portion 32*d* which facilitates insertion of the tab between the attachment strip's center tab 34*d* and its first gasket 36. A similar contoured edge and spaced tab arrangement of another adjacent panel (not shown for simplicity) facilitates attachment of another panel to the attachment strip 34 in a sealed manner. The spaced tabs 32*b* along the edge of the panel 32 allow for its flexibility and permit the panel edge to assume the same contour as the support structure to which the flexible attachment strip 34 is attached. In this manner, the panels attached to a curvilinear support structure using the snap-in panel arrangement 30 can be configured in gracefully curved shapes while securely attached to and closely conforming to the outer contour of the support structure. Although the metal panels which are particularly adapted for use with the snap-in panel mounting arrangement of the present invention are comprised of steel or aluminum, the inventive panel mounting arrangement may be used with virtually any of he conventional panel covering materials used in building construction.

Referring to FIG. 4, there is shown a sectional view of a coupling arrangement between an attachment strip 42 and a panel 40 which employs an alternate embodiment of a gasket 50. As in the arrangement described above, the attachment strip 42 includes a base portion 42*a*, an outer tab 42*b*, and a center tab 42*c* having an arrowhead-shaped tip, or distal end, 42*d*. A second outer tab of the attachment strip 42 is not shown for simplicity. The base portion 42*a* is adapted for secure attachment to a support structure 58 as previously described. Also as previously described, the panel 40 includes an edge portion extending from the plane of the generally flat portion of the panel. The edge portion includes a proximal leg 40*a* attached to and continuous with the generally planar portion of the panel 40 and a distal leg 40*b* extending outwardly from the proximal leg portion of the panel. The panel 40 is preferably comprised of a somewhat flexible, resilient metal to permit the edge portion, including the proximal and distal leg portions 40*a*, 40*b*, to flex when inserted in the attachment strip 42 as previously described.

The gasket 50, which also as previously described as preferably comprised of a compressible, resilient material such as rubber or plastic, is adapted for positioning between the edge portion of the panel 40 and the outer tab 42*b* of the attachment strip 42. The gasket 50 is preferably positioned on and in contact with the edge portion of the panel 40 prior to insertion between the outer and center tabs 42*b*, 42*c* of the attachment strip 42. The gasket 50 may be maintained in position on the edge portion of the panel 40 prior to insertion on the attachment strip 42 by a conventional adhesive.

The gasket includes an inner portion 50*a*, a curvilinear portion 50*b*, an upper portion 50*d*, a lower portion 50*e*, and an outer portion 50*f*. All of the aforementioned parts of the gasket 50 form a continuous, elongated, linear structure which is adapted for attachment to the edge of a panel 40 as shown in FIG. 4. The inner portion 50*a*, lower portion 50*e*, and the outer portion 50*f* of the gasket 50 define a central channel, or slot, 50*g*. The central channel 50*g* allows for displacement between the outer portion 50*f* and the inner portion 50*a* of the gasket as the lower portion 50*e* flexes upon insertion of the panel edge and gasket between the outer and center tabs 42*b*, 42*c* of the attachment strip 42. The outer surface of the outer portion 50*f* is provided with a plurality of spaced ribs, or teeth, 50*h* for securely engaging an inner surface of the outer tab 42*b* and inhibiting removal of the gasket and panel edge combination from the attachment strip 50 once it's inserted therein. The curvilinear portion 50*b* of the gasket 50 defines an inner cavity 50*c* and the flexible, resilient characteristics of the gasket allow the curvilinear gasket portion to be deflected, or to flex, upon contact with a distal end of the attachment strip's outer tab 42*b* . Secure, abutting engagement between the gasket's curvilinear portion 50*b* and the attachment strip's outer tab 42*b* forms a weather-proof seal to prevent water and other elements from entering the space between the panel 40 and the support structure 58 to which the attachment strip 42 is secured.

There has thus been shown a snap-in panel mounting arrangement for securely attaching a panel either in the form of a flat sheet or a pair of flat sheets with an insulating layer disposed therebetween to a support structure. The panel mounting arrangement forms a weather-proof seal between adjacent panels as well as between the panels and the underlying support structure and minimizes the panel mounting and coupling hardware which is visible. The inventive panel mounting arrangement is inexpensive, allows for easy and quick attachment of the panels to a support structure, and is adapted for attaching flexible panels to a curvilinear support structure wherein the panels assumed the outer contour of the support structure.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An arrangement for attaching a generally flat panel to a support structure comprising:

an attachment strip mounted to said support structure and including first and second spaced tabs extending along the length of said strip and forming a slot along said strip, said first tab having an enlarged, beveled distal end with a first contoured surface and a proximal edged portion and said second tab having a flat inner surface facing and angled toward said first tab;

first compressible, resilient sealing means disposed intermediate said first tab and said second tab and within said slot and extending along the length of said strip; and an edge portion on the panel forming an angle with a plane of said panel and having a second contoured surface, wherein said second contoured surface is complementary to said first contoured surface and said edge portion is adapted for tight fitting insertion between said first tab and said sealing means so as to place said first and second contoured surfaces in intimate contact and wherein said sealing means provides a seal between said attachment strip and an inner surface of the flat panel, with the beveled distal end of said first tab facilitating insertion of the edge portion of the panel between said first tab and said sealing means and the proximal edge portion of said first tab securely engaging the edge portion of the panel, and wherein the flat inner, angled surface of said second tab securely engages said sealing means in a wedge-like manner when said sealing means is inserted between said first and second tabs.

2. The arrangement of claim 1 wherein the first contoured surface of said first tab includes a distal beveled portion to facilitate insertion of the edge portion of the panel between said first tab and said sealing means and a proximal edged portion for securely engaging said edge portion of the panel.

3. The arrangement of claim 2 wherein the enlarged distal end is generally arrowhead-shaped.

4. The arrangement of claim 2 wherein said second tab includes an inner surface facing and angled toward said first tab for securely engaging said sealing means in a wedge-like manner when said sealing means is inserted between said first and second tabs.

5. The arrangement of claim 4 wherein said second tab further includes a beveled distal end to facilitate insertion of said sealing means intermediate said first and second tabs.

6. The arrangement of claim 1 wherein said sealing means comprises an elongated gasket.

7. The arrangement of claim 6 wherein said gasket is comprised of rubber.

8. The arrangement of claim 6 wherein said gasket is comprised of elastomeric plastic.

9. The arrangement of claim 6 wherein said gasket includes an inner channel extending the length thereof for improved compressibility of said gasket.

10. The arrangement of claim 6 wherein said gasket includes a plurality of spaced ribs for engaging said second tab and securely maintaining said gasket between said first and second tabs.

11. The arrangement of claim 1 wherein said attachment strip is comprised of extruded aluminum.

12. The arrangement of claim 1 wherein said attachment strip is comprised of plastic.

13. The arrangement of claim 1 wherein said attachment strip is comprised of formed metal.

14. The arrangement of claim 1 wherein said edge portion of the panel forms an angle of approximately 110° with the plane of the panel.

15. The arrangement of claim 14 wherein said edge portion of the panel includes offset proximal and distal leg portions adapted for securely engaging the first tab of said attachment strip.

16. The arrangement of claim 1 wherein said panel is attached to a first side of an insulating layer and wherein said insulating layer is attached on a second facing side thereof to a second panel.

17. The arrangement of claim 16 wherein said insulating layer is comprised of an insulating foam.

18. The arrangement of claim 16 wherein said second panel is positioned adjacent to the support structure.

19. The arrangement of claim 1 wherein the panel is comprised of sheet metal.

20. The arrangement of claim 1 wherein said support structure has a contoured outer surface and wherein said attachment strip is flexible to closely conform to the contoured outer surface of the support structure.

21. The arrangement of claim 20 wherein said edge portion of the panel includes a plurality of spaced tabs along the length thereof with a slot between each pair of adjacent edge tabs to allow the panel to flex and conform to the contoured outer surface of the support structure when attached to said flexible attachment strip.

22. A snap-acting arrangement for attaching first and second panels to a support structure, said arrangement comprising:

an attachment strip affixed to the support structure and including first and second outer tabs and a center tab disposed therebetween so as to define first and second slots respectively disposed between said first and second outer tabs and said center tab, said center tab including an enlarged, beveled distal end portion and first and second opposed proximal edged portion sand each of said first and second outer tabs including a flat surface facing and angled toward said center tab;

first and second angled edge portions respectively disposed on the first and second panels and adapted to engage in an abutting manner respective facing surfaces of said center tab; and first and second compressible, resilient means disposed in a tight-fitting manner between said center tab and said first and second outer tabs for permitting said first and second edge portions to be inserted in said attachment strip in a snap-acting manner and for maintaining the thus inserted first and second edge portions in intimate contact with said center tab, wherein the beveled distal end portion of said center tab facilities insertion of said first and second compressible, resilient means respectively between said center tab and said first and second outer tabs and said first and second opposed proximal edged portions of said center tab securely engage the first and second angled edge portions of said first and second panels, respectively, and wherein said flat, angled surfaces of said first and second outer tabs securely engage said first and second compressible, resilient means, respectively, in a wedge-like manner when said resilient means are inserted between said center tab and a respective one of said outer tabs.

23. The arrangement of claim 22 wherein the support structure has a contoured, outer surface and said attachment strip is flexible to conform with said contoured, outer surface of the support structure, and wherein each of said edge portions includes means for allowing flexure of the edge portion and conformance of the edge portion of each of the panels with said flexible attachment strip to which the panels are coupled.

24. The arrangement of claim 23 wherein said means for allowing for flexure of an edge portion includes a plurality of spaced tabs disposed along the edge portion.

25. The arrangement of claim 22 further comprising first and second insulating layers each having respective first surface portions attached to an inner surface of each of the first and second panels and further including third and fourth panels attached to second facing surface portions of each of said first and second insulating layers.

26. The arrangement of claim 25 wherein said insulating layers are comprised of an insulating foam.

27. The arrangement of claim 25 wherein each pair of adjacent, compressible, resilient means and its associated outer tab forms a seal for isolating an insulating layer from the environment at an outer portion of the panels.

28. The arrangement of claim 22 wherein said center tab includes angled and recessed portions on facing lateral surfaces thereof for securely engaging the edge portions of the first and second panels.

29. The arrangement of claim 28 wherein said center tab includes an enlarged distal end forming said angled and recessed portions and facing lateral surfaces thereof.

30. The arrangement of claim 29 wherein the enlarged distal end of said center tab is generally arrowhead-shaped.

* * * * *

UNITED STATES PATENT AND TRADEMARK OFFICE

CERTIFICATE OF CORRECTION

PATENT NO. : 5,125,204

DATED : June 30, 1992

INVENTOR(S) : William H. Porter

It is certified that error appears in the above-identified patent and that said Letters Patent is hereby corrected as shown below:

ON THE TITLE PAGE: [pg. 1]

Under "References Cited" Section

Under "U.S. PATENT DOCUMENTS"

Patent No. 3,232,395 to LaBarge should have an issue date of --2/1966--, not "1/1966".

Under "FOREIGN PATENT DOCUMENTS"

Patent No. 250639 issued 1/1966 should be from --Austria--, not "Australia".

Abstract, item [57];

Line 19 After "thereof", delete "which are" and insert therefor --and a panel--.

Item [56]:

Under "References Cited" Section

Under "U.S. PATENT DOCUMENTS"

Patent No. 4,020,611 to Amos should have an issue date of --5/1977--, not "6/1977".

| COLUMN | LINE | DESCRIPTION |
|---|---|---|
| 2 | 62 | "detalled" should be --detailed--. |

UNITED STATES PATENT AND TRADEMARK OFFICE

CERTIFICATE OF CORRECTION

PATENT NO. : 5,125,204

DATED : June 30, 1992

INVENTOR(S) : William H. Porter

It is certified that error appears in the above-identified patent and that said Letters Patent is hereby corrected as shown below:

| | | |
|---|---|---|
| 5 | 61 | "he" should be --the--. |
| 8 | 54 | "portion sand" should be --portions and--. |

Signed and Sealed this

Tenth Day of August, 1993

*Attest:*

*Attesting Officer*

Michael K. Kirk

MICHAEL K. KIRK

*Acting Commissioner of Patents and Trademarks*